US006320161B1

(12) United States Patent
Hansen, Jr.

(10) Patent No.: US 6,320,161 B1
(45) Date of Patent: Nov. 20, 2001

(54) POCKET USE HAND WARMER

(76) Inventor: Howard O. Hansen, Jr., P.O. Box 149761, Orlando, FL (US) 32814

( * ) Notice: Subject to any disclaimer, the term of this patent is extended or adjusted under 35 U.S.C. 154(b) by 0 days.

(21) Appl. No.: 09/657,557

(22) Filed: Sep. 8, 2000

(51) Int. Cl.[7] ..... H05B 1/00

(52) U.S. Cl. ..... 219/211; 219/212; 219/527; 219/528; 219/533

(58) Field of Search ..... 219/211, 212, 219/217, 527, 528, 529, 533, 535, 544, 549; 392/432, 435

(56) References Cited

U.S. PATENT DOCUMENTS 3,569,666 * 3/1971 Murphy ..... 219/211
3,663,796 * 5/1972 Hines et al. ..... 219/211
3,663,797 * 5/1972 Marsh ..... 219/211
3,796,855 * 3/1974 Brown et al. ..... 219/211
4,021,640 * 5/1977 Gross et al. ..... 219/211
4,042,803 * 8/1977 Bickford ..... 219/211
4,201,218 * 5/1980 Feldman et al. ..... 219/527
4,531,410 * 7/1985 Wehmeyer ..... 219/211
4,950,868 * 8/1990 Moss et al. ..... 219/211
5,101,515 * 4/1992 Holt et al. ..... 219/528
5,302,807 * 4/1994 Zhao ..... 219/211
5,620,621 * 4/1997 Sontag ..... 219/211

* cited by examiner

*Primary Examiner*—Teresa Walberg
*Assistant Examiner*—Fadi H. Dahbour

(57) ABSTRACT

A hand warming device for use in ones jacket or pants pocket, being portable, and having controllable heating. Uses for the device include warming the hand before touching others as in handshakes.

1 Claim, 2 Drawing Sheets

POCKET USE HAND WARMER

BACKGROUND OF THE INVENTION

1. Field of Invention

The field of invention relates to a new and improved way to warm the hand for exclusive use in the art of hand shaking or touching of others.

2. Description of the Prior Art

There are several hand warming devices and apparatus that have been patented. Examples of these are as follows:

U.S. Pat. No. 3,569,666 to Murphy et al, sets forth a self contained low voltage battery operated glove for heating the hand. Dated Mar. 9, 1971. This method uses a battery as the source of heat to heat up a resistor that connects to a heating element that heats the glove.

U. S. Pat. No. 4,021,640 to Alexander Louis Gross, sets forth an Insulated Glove which has battery powered heating elements connected to the glove.

U.S. Pat. No. 4,950,868 to Gary Moss et al, sets forth Heated Gloves which uses a battery to provide a heat source for heating elements to heat the glove.

U.S. Pat. No. 4,532,410 to Betty Wehmeyer sets forth a Low voltage Battery Operated Heating Bib.

U.S. Pat. No. 5,620,621 to Richard Sontag sets forth a Glove having heating element located in the palm region.

U.S. Pat. No. 4,201,218 Henry Feldman et al, sets forth Therapeutic Heat Application.

U.S. Pat. No. 3,663,796 to Benjamin Hines, et al sets forth a electrically Heated Boot Sock and battery support pouch.

U.S. Pat. No. 5,302,807 to Zhi-Rong Zhao sets forth a Electrically heated garment with oscillator control for heating element.

U.S. Pat. No. 5,101,515 to Patricia Holt et al sets forth a Jacket Pack that uses battery heating within the design for this jacket.

These hand warming devices are connected to clothing, such as gloves, socks, jackets or heating garments and bibs. These units are impractical for use in warming the hand for hand shaking. One can not place his hand in the glove and remove it each time he shakes hand with out attracting attention to his device. This would not be good for the art of hand shaking. Some hand warming devices available are enclosed in clothing or gloves and activated by external wires from a battery pack that would show and be a problem for the hand shaker. Some hand warming devices heated up to temperatures in excess of 130 degrees fahrenheit. Some of the devices were too bulky for use in the pocket and they were lighted by use of matches or they produced heat via a direct chemical reaction.

SUMMARY OF THE INVENTION

In view of the fore going disadvantages inherent in the known types of hand warming devices with respect to the art of hand shaking or touching others, the present invention produces a method to provide a friendly warm hand shake or touch that is critical in making first impressions with social friends or business clients.

This device would warm the palm of the hand making a much more pleasant contact for the handshake or touching. This device allows one to carry and conceal the device in the jacket or pants pocket and activate it while in the pocket to produce controllable heat for ones use. Thus after activation, one can hand shake with a warmer hand. One can also use the device several times without any one being aware of the device. Simply put you hand in the pocket and activate the machine then shake hands then put your hand back in the pocket. No gloves or bibs to fool with and no one will see your device which is very important in the art of hand shaking.

DESCRIPTION OF THE PREFERRED EMBODIMENT

Figure 1:
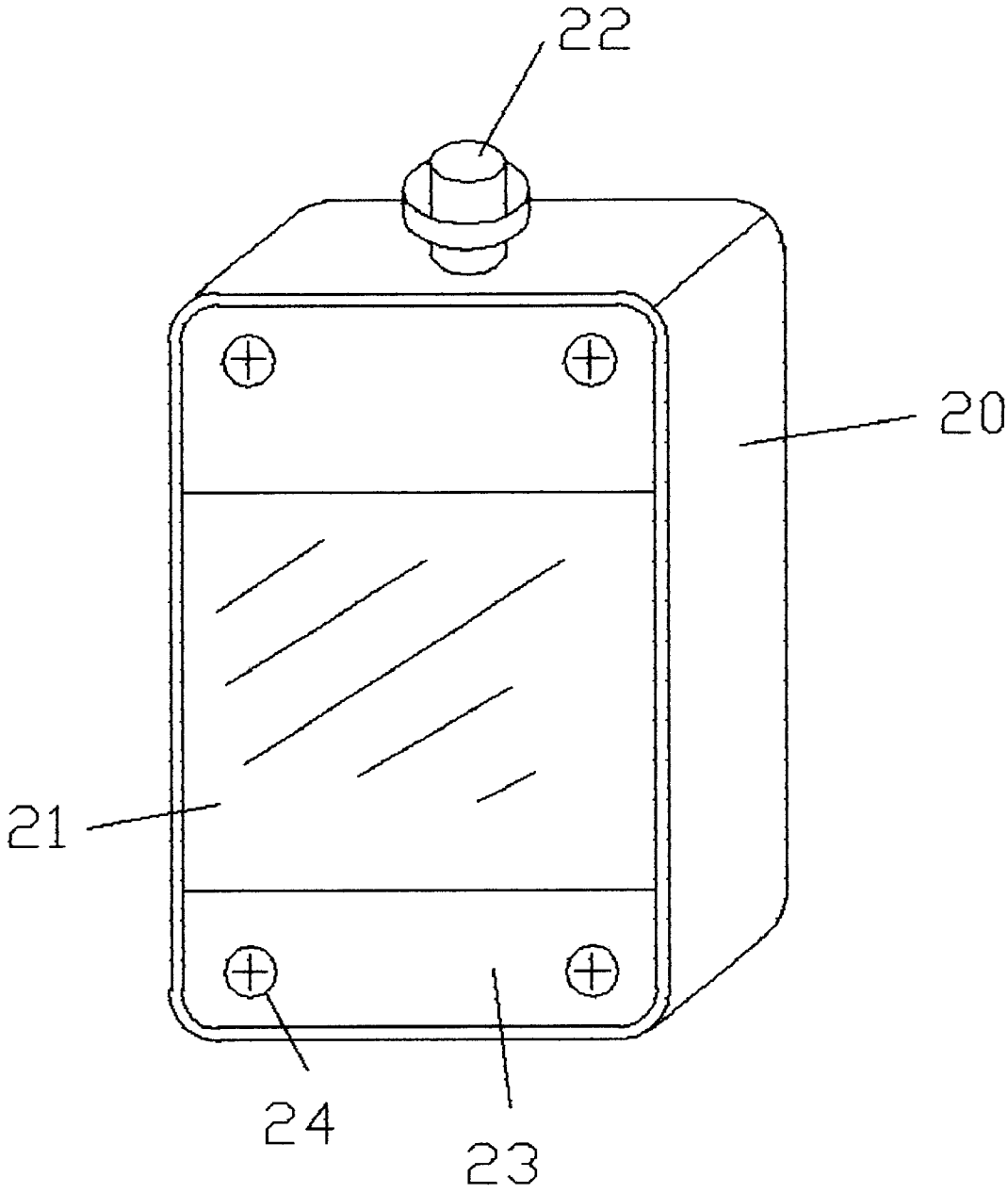
FIG. 1 is the front plan view of the assembled hand shake warming device.

Referring to the drawings, there is illustrated in FIG. 1 a palm size plastic container 20, housing the entire assembly for this product. The outside of the container consist of a front aluminum plate 23, which is wrapped with several layers in a strip of aluminum foil 21. The top of the container shows a pressing activated switch 22. The front plate of aluminum is held to the plastic container by four attachment screws 24 that are used to open the unit for battery installation.

Figure 2:
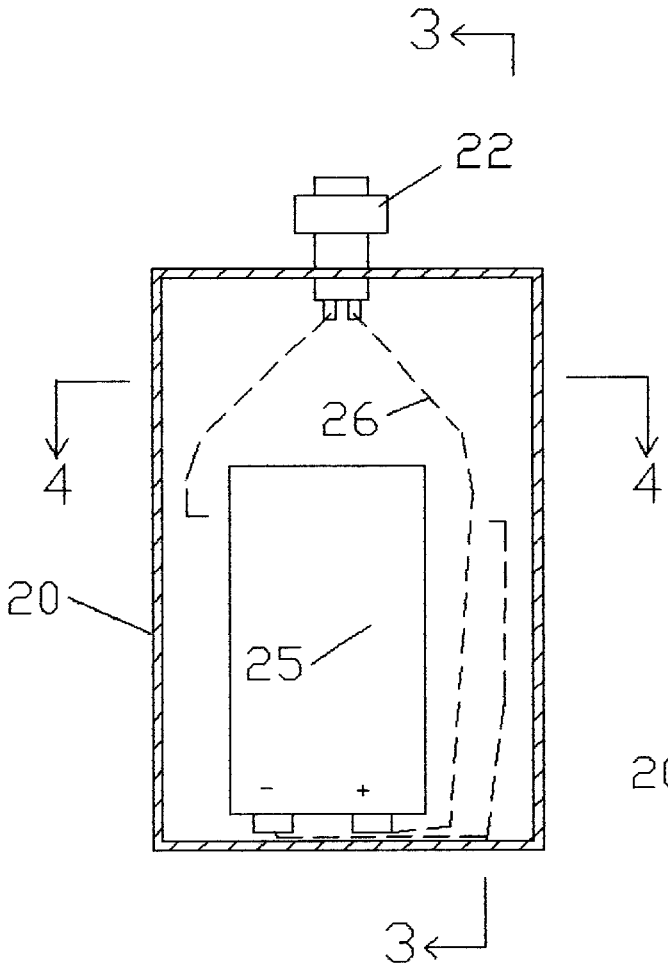
FIG. 2 is the front view of the inside portion of the hand shake warming device with the covering plate removed.

Referring to FIG. 2, there is illustrated an interior plan view of the container 20, which shows the battery 25, which is the source of the heating unit. The battery is a low voltage unit, 9 volt or less. Electrical current is conducted from the battery to the press activated switch 22, via insulated copper wires 26.

Figure 3:
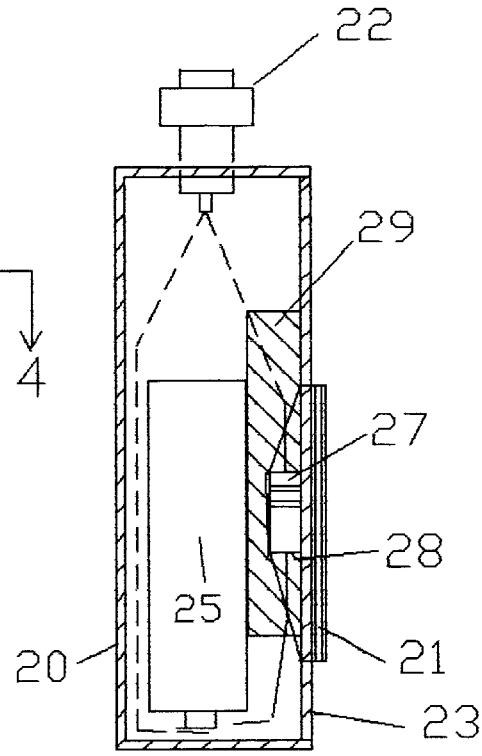
FIG. 3 is a detailed cross section of the side view of the hand shaking warming device taken by line 3—3.

Referring to FIG. 3, there is illustrated an interior section view 3—3 of the container 20. When the switch is pressed and held, the current flows from the battery 25, through the switch to a resistor 27. The resistor is wrapped in a strip of aluminum foil 21, and heat sink compound 28 is placed in the wrap. The resistor heats up from the electrical current from the battery and transfers the heat to the outside aluminum plate 23, and aluminum strip 21, wrapped around the plate. A foam insulator 29, is placed between the battery and the aluminum wrapped resistor 27.

Figure 4:
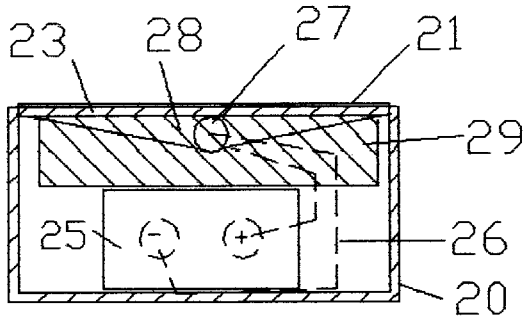
FIG. 4 is a detailed cross section of the top view of the inside portion of the hand shake warming device taken along line 4—4.

Referring to FIG. 4, there is illustrated an interior section view 4—4 of the container. This shows the view of the electrical circuit from the top of the container 20. Current flows from the battery 25, through the wires 26, to the switch, not shown, then to the resistor 27, which is wrapped in aluminum foil 21, with heat sink compound added 28. The foam insulator 29 keeps the resistor separated from the battery. The aluminum plate 23, is shown on the front of the view.

Having described my invention, what I claim as new, and desire to secure by Letter of Patent is:

1. A hand shaking/touching warmer device, comprising:

a plastic container with an aluminum front plate wrapped in aluminum foil containing a battery operated device using a resistor for a heating element, the warmer device being a palm sized heating device which can be safely stored and concealed in ones pocket or jacket and be used several times with out any ones knowledge of the device, the warmer device having an activated switch that when pressed and held will allow the warmer device to control the heat into the warmer device, the warmer device being a hand heating unit expressly used to provide warmth for the hand prior to hand shaking or touching of others.

* * * * *